US009249575B2

(12) United States Patent
Hutchison et al.

(10) Patent No.: US 9,249,575 B2
(45) Date of Patent: Feb. 2, 2016

(54) REBAR CENTRALIZER

(71) Applicant: Pile Protection Tops Inc., Kansas City, KS (US)

(72) Inventors: Randall Jesse Hutchison, Overland Park, KS (US); David Ray Henkle, Kansas City, KS (US); Todd Longhurst, Mount Pleasant, IA (US)

(73) Assignee: Pile Protection Tops Inc., Kansas City, KS (US)

( * ) Notice: Subject to any disclaimer, the term of this patent is extended or adjusted under 35 U.S.C. 154(b) by 0 days.

(21) Appl. No.: 14/679,694

(22) Filed: Apr. 6, 2015

(65) Prior Publication Data

US 2015/0284958 A1 Oct. 8, 2015

Related U.S. Application Data

(60) Provisional application No. 61/975,431, filed on Apr. 4, 2014.

(51) Int. Cl.

| | |
|---|---|
| ***E21B 17/10*** | (2006.01) |
| ***E04C 5/16*** | (2006.01) |
| *E04C 5/20* | (2006.01) |

(52) U.S. Cl.

CPC . *E04C 5/16* (2013.01); *E04C 5/203* (2013.01); *E21B 17/1021* (2013.01); *E21B 17/1078* (2013.01)

(58) Field of Classification Search

CPC ..... E21B 17/1028; E21B 17/1021; E21B 17/1078; E21B 17/10; E02D 5/34; E04C 5/203; E04C 5/208; E04C 5/16; E04C 5/168; E04C 5/18

USPC ..... 166/241.7, 241.6, 213, 241.1, 172, 166/241.2, 241.5; 52/677, 649.4, 649.7, 52/713; 175/325.5; 405/239

See application file for complete search history.

(56) References Cited

U.S. PATENT DOCUMENTS

| | | | | |
|---|---|---|---|---|
| 1,708,277 | A * | 4/1929 | Martin | 52/649.4 |
| 1,950,526 | A * | 3/1934 | Stetter | A44C 9/00 63/15.5 |
| 1,972,128 | A * | 9/1934 | Bobbroff | A44C 9/0015 273/158 |
| 3,176,771 | A * | 4/1965 | Claiborne et al. | 166/173 |
| 3,858,653 | A * | 1/1975 | Turbyfill | 166/173 |
| 4,159,742 | A * | 7/1979 | Alexander, Jr. | 166/173 |
| 4,269,269 | A * | 5/1981 | Wilson | 166/241.7 |
| 4,909,322 | A * | 3/1990 | Patterson et al. | 166/241.7 |
| 5,224,959 | A * | 7/1993 | Kasper | A63B 21/0084 446/26 |
| 5,329,824 | A * | 7/1994 | Carapezza et al. | 73/866.5 |

(Continued)

OTHER PUBLICATIONS

Foundation Technologies, Inc., Unispacer, http://www.foundationtechnologies.com/Unispacer.php, Mar. 5, 2014, 2 pages.

(Continued)

*Primary Examiner* — Joshua J Michener
*Assistant Examiner* — Kyle Walraed-Sullivan
(74) *Attorney, Agent, or Firm* — Hovey Williams LLP

(57) ABSTRACT

Apparatuses, systems, and methods for centralizing rebar in a shaft are provided. The systems include a rebar centralizer system comprising a first ring and a second ring configured to be positioned in an angular relationship with each other. The first and second rings are configured to at least partially intersect so as to present at least one interior corner in which a section of rebar can be secured.

20 Claims, 9 Drawing Sheets

(56) References Cited

U.S. PATENT DOCUMENTS

| | | | | |
|---|---|---|---|---|
| D379,105 | S * | 5/1997 | Wilk | D21/714 |
| 5,699,642 | A * | 12/1997 | McDevitt, Jr. | E04C 5/162 24/16 PB |
| 6,102,118 | A * | 8/2000 | Moore | 166/241.7 |
| 6,167,957 | B1 * | 1/2001 | Frazier | 166/55.2 |
| 6,367,556 | B1 * | 4/2002 | Moore | 166/378 |
| 6,568,982 | B2 * | 5/2003 | Esterle | A63H 33/06 446/122 |
| 6,725,939 | B2 * | 4/2004 | Richard | 166/384 |
| 2004/0040247 | A1 * | 3/2004 | Morse | E04C 5/166 52/649.8 |
| 2008/0196901 | A1 * | 8/2008 | Aguirre et al. | 166/381 |
| 2013/0212974 | A1 * | 8/2013 | Sullivan | 52/659 |

OTHER PUBLICATIONS

C&M Duraflex PVC Centralizers, The industry standard, http://www.centralizers.com/Duraflex PVC Centralizers, PVC D2K Centralizers, C&M Manufacturing Co., Santee, CA, Mar. 5, 2014, 4 pages.

* cited by examiner

REBAR CENTRALIZER

CROSS-REFERENCE TO RELATED APPLICATION

This non-provisional patent application claims the benefit of U.S. Provisional Patent Application No. 61/975,431, filed Apr. 4, 2014, entitled "REBAR CENTRALIZER," which is incorporated by reference herein in its entirety.

BACKGROUND

1. Field of the Invention

This invention relates generally to a rebar centralizer. More particularly, this invention relates to apparatuses, systems, and methods for securing a section of rebar to a centralizer so as to centrally positioning the section of rebar in a shaft.

2. Description of the Related Art

Various construction applications require the use of reinforcement bars (i.e., rebar) for increasing the strength and stability of foundations and structures. For instance, in the case of micro piles, auger cast piles, drilled shafts, caissons, and anchors, it is sometimes necessary to position sections of rebar centrally within a vertically extending shaft. However, because the diameter of the rebar is generally much smaller than the diameter of the shaft, it is difficult to keep the rebar centrally-positioned within the shaft. Several conventional centralizers (sometimes called "footballs") have been designed and manufactured for this purpose. Such conventional centralizers, however, are generally expensive to produce, costly to ship in bulk, complicated to assemble in the field, and complicated to attach to the rebar. Furthermore, conventional centralizers are often only made to fit specific sizes of shafts and specific sizes of rebar. As such, conventional centralizers may not be configured for use in many custom construction applications.

As such, there is a need for a rebar centralizer that is inexpensive to manufacture and ship and simple to assemble in the field. Furthermore, there is a need for a rebar centralizer than can be used with rebar of various types and of various sizes.

SUMMARY OF THE INVENTION

In one embodiment of the present invention, there is provided a rebar centralizer system comprising a first ring and a second ring configured to be positioned in an angular relationship with the each other. The first and second rings are configured to at least partially intersect so as to present at least one interior corner.

In another embodiment of the present invention, there is provided a method for centrally positioning a section of rebar in a shaft formed in section of material. The method comprises an initial step of providing a first ring and a second ring at least partially intersecting so as to present at least one interior corner. A next step includes positioning the section of rebar adjacent to the first and second rings and within the interior corner. A next step includes securing the section of rebar with the first and second rings. A further step includes placing the section of rebar within the shaft.

In yet another embodiment of the present invention, there is provided a rebar centralizer component comprising a first generally ring-shaped element including a first half and a second half. An inner diameter of the first ring-shaped element as measured across the first half is greater than an inner diameter of the first ring-shaped element as measured across the second half. Additionally, an interior surface of the first half includes at least one notch for receiving a portion of a second ring-shaped piece.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE FIGURES

Embodiments of the present invention are described herein with reference to the following drawing figures, wherein.

Figure 1:
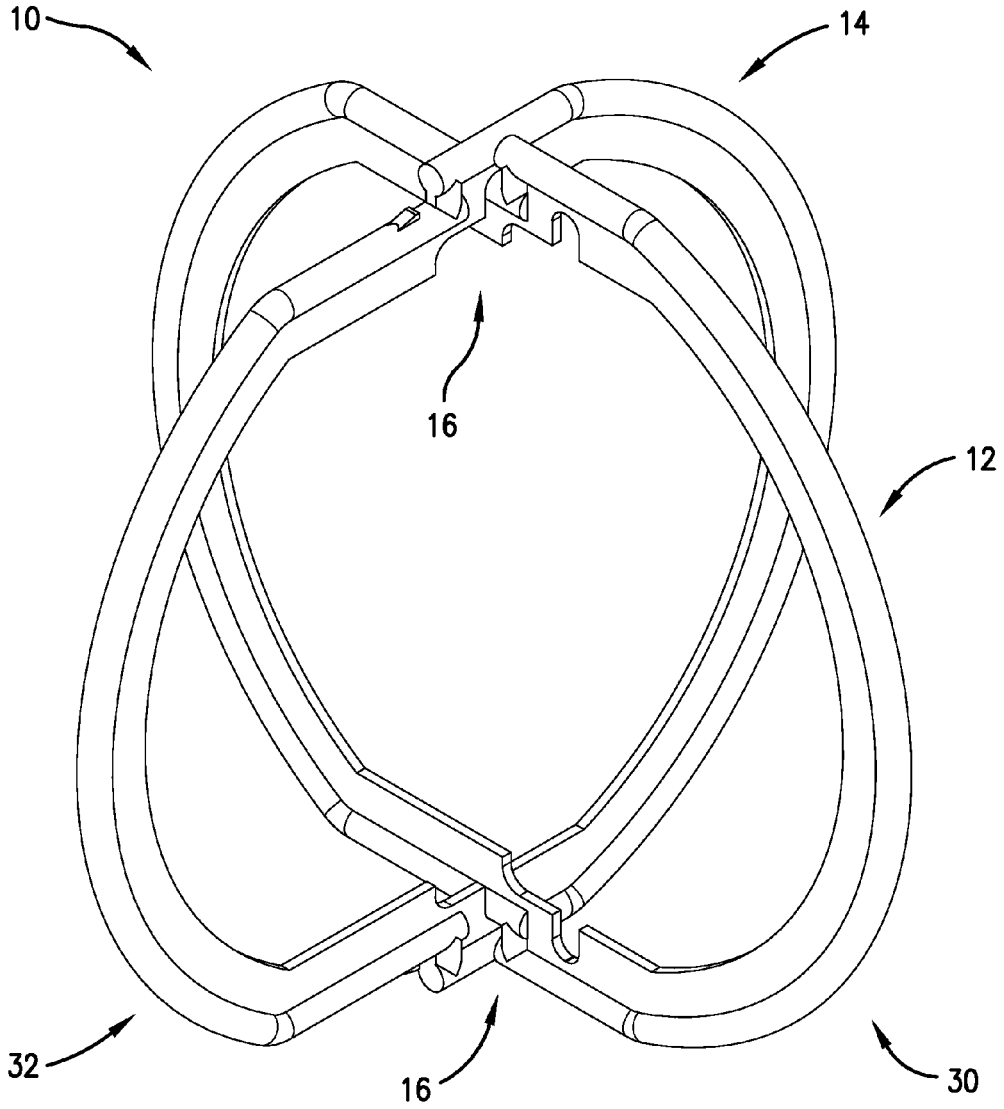
FIG. 1 is a perspective view of a rebar centralizer system according to one embodiment of the present invention, particularly showing a first ring and a second ring.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
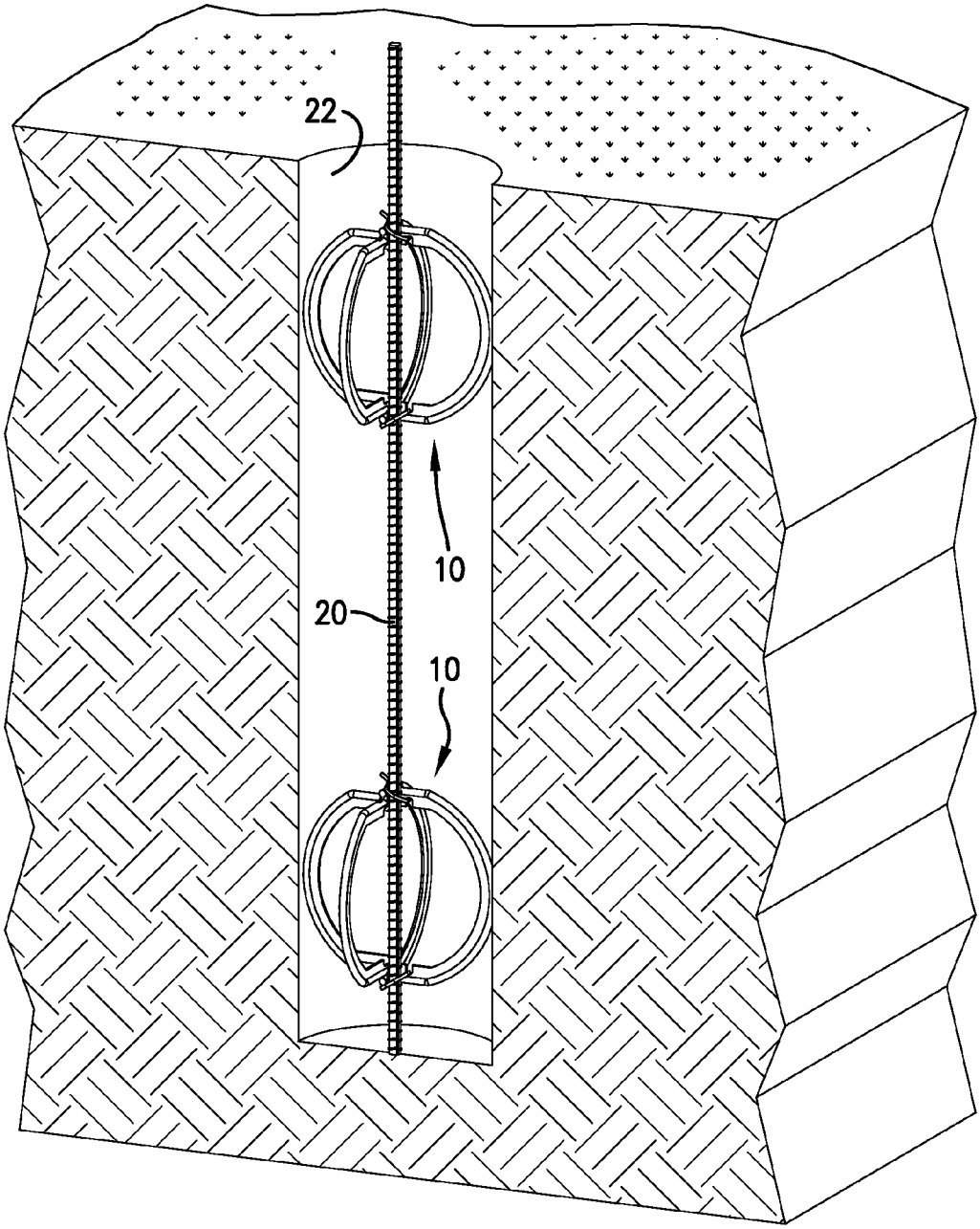
FIG. 2 is a side cross-sectional view of a shaft with a section of rebar and two rebar centralizer systems from FIG. 1 inserted therein.

FIG. 1 depicts one embodiment of a rebar centralizer system 10 in accordance with the present invention. The rebar centralizer system 10 comprises a first ring 12 and a second ring 14 configured to be positioned in an angular relationship with the first ring 12. As shown in FIG. 1, the first and second rings 12, 14 are configured to at least partially intersect so as to present at least one interior corner 16 that is configured to receive a section of rebar. As such, and as illustrated in FIG. 2, one or more of the rebar centralizer systems 10 can be secured to a section of rebar 20 such that the section of rebar 20 can be centrally positioned in a shaft 22 formed in a section of material (e.g., a hole drilled in a section of the earth and/or ground). To accomplish the section of rebar 20 being centrally positioned, the rebar centralizer systems 10 contact the sidewalls of the shaft 22, such that the rebar centralizer systems 10 support the section of rebar 20 in a centralized manner within the shaft 22.

As used herein, the term "rebar" is defined to mean a reinforcing bar, such as a metal (e.g., steel or iron) section of wire, rod, pipe, beam, or the like. Rebar is often used as a tension device in reinforced concrete structures to strengthen the concrete and hold it in tension. In certain instances, the exterior surface of the rebar can be patterned to enhance bonding with the concrete. As illustrated in FIG. 2, for instance, the section of rebar 20 is positioned within the shaft 22 and wet concrete can be poured into the shaft 22 over the section of rebar 20 to form a foundation element, such as a pile, an anchor, or the like. In other embodiments, wet concrete (or slurry mix) may be provided within the shaft 22 prior to insertion of the section of rebar 20. For instance, wet concrete may be injected from a bottom of an auger that forms the shaft 22 as the auger is being retracted from the shaft 22. Regardless, for many foundation elements, it is beneficial for the section of rebar 20 to be centrally aligned with a longitudinal centerline of the shaft 22. As such, the section of rebar 20 can carry tension in alignment with the foundation element so as to make the foundation element more solid and stable. Furthermore, by centrally positioning the section of rebar 20, cover for the section of rebar 20 can be maximized. As used herein, the term cover is defined to mean the radial distance between the section of rebar 20 and the outer surface of the concrete poured into the shaft 22. In more detail, when concrete is poured in a shaft, such as shaft 22 illustrated in FIG. 2, the amount of cover is determined to be the radial distance between the section of rebar 20 and the sidewall of the shaft 22. Maximizing cover allows the section of rebar 20 to be separated from the material in which the shaft 22 was formed (e.g., the earth/ground) so as to reduce corrosion of the section of rebar 20 and to enhance thermal insulation between the material in which the shaft 22 was formed and the section of rebar 20.

Figure 3:
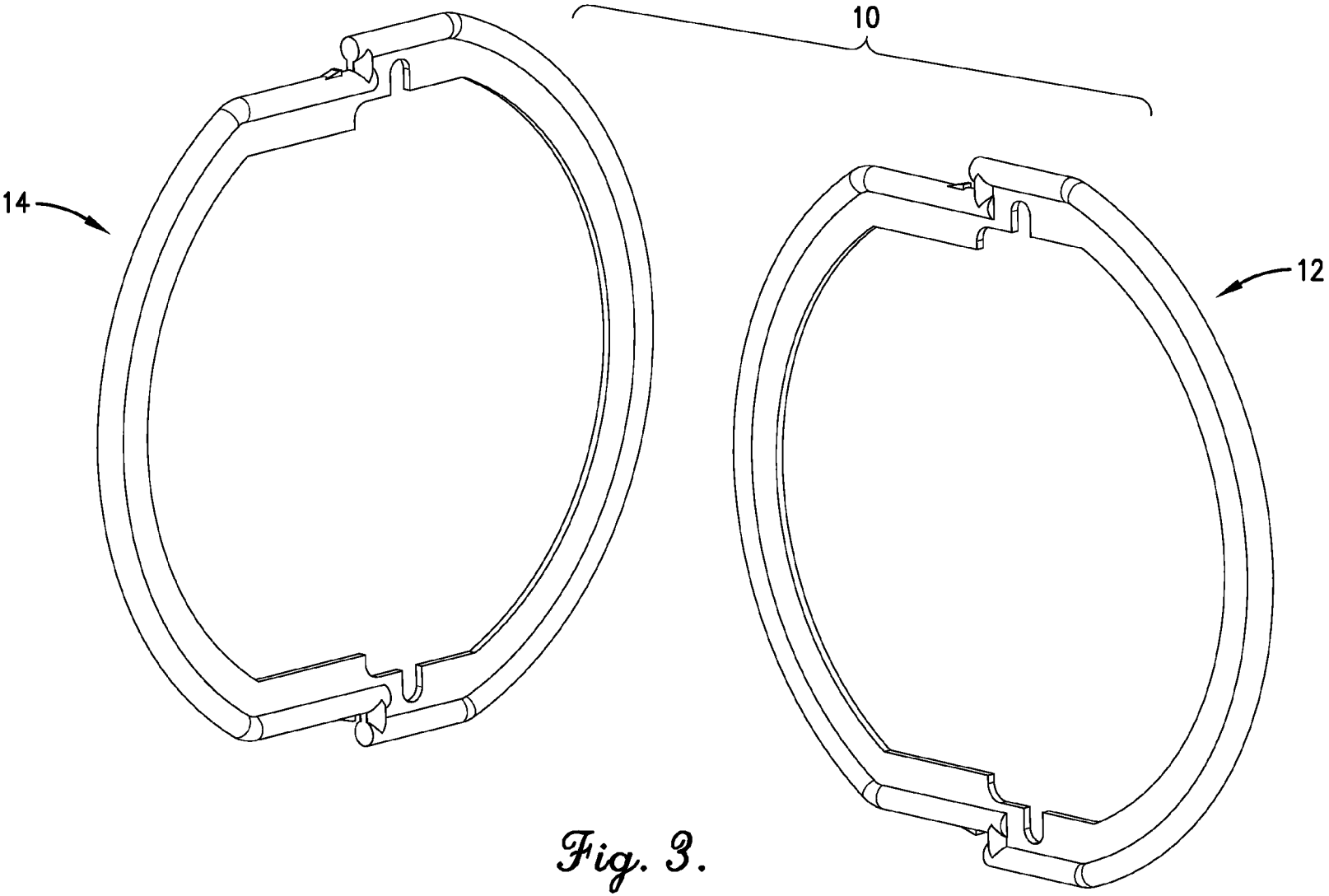
FIG. 3 is an exploded view of the rebar centralizer system of FIG. 1.

Returning to the rebar centralizer system 10, the first and second rings 12, 14 may be formed as generally identical ring-shaped elements, as is illustrated in FIG. 3. In some embodiments, the rings 12, 14 may be formed from metal, such as iron, steel, stainless steel, carbon-modified steel, or the like. Alternatively, the rings 12, 14 may be formed from various types of non-metals, such as plastics, epoxies, composites, and the like. In embodiments in which the rings 12, 14 are formed from non-metals, the rings 12, 14 may be created via injection molding, 3-Dimensional printing, or the like.

Figure 4:
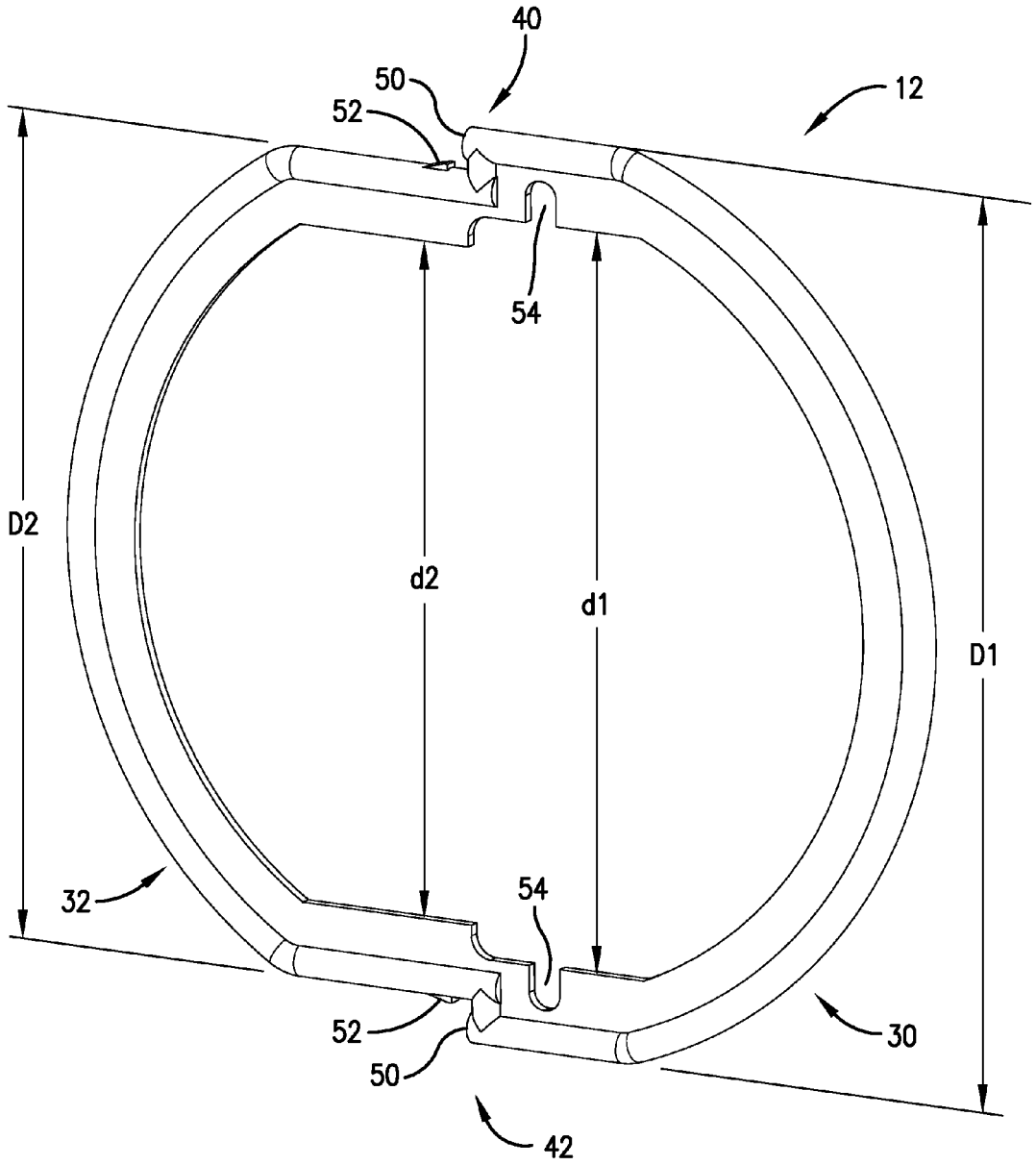
FIG. 4 is a perspective view of the first ring from the rebar centralizer system from FIG. 1.

Turing to the rings 12, 14 in more detail, an individual ring, in the form of first ring 12, is illustrated in FIG. 4. The ring 12 comprises a first half section 30 and a second half section 32. For clarity, as used herein, the term "half section" means one of two portions of one of the rings 12, 14 and does not necessarily mean one of two equal parts of one of the rings 12, 14. The first and second half sections 30, 32 meet at a top portion 40 and at a bottom portion 42 of the ring 12. As shown in FIG. 4, an inner diameter d1 of the ring 12 as measured between the top and bottom portions 40, 42 of the ring's 12 first half section 30 may be greater than the inner diameter d2 of the ring 12 as measured between the top and bottom portions 40, 42 of the ring's 12 second half section 32. Correspondingly, an outer diameter D1 of the ring 12 as measured between the top and bottom portions 40, 42 of the ring's 12 first half section 30 may be greater than the outer diameter D2 of the ring 12 as measured between the top and bottom portions 40, 42 of the ring's 12 second half section 32.

As shown in FIG. 4, because the outer diameter D1 of the ring 12 is larger at the first half section 30, a transitional section between the first half section 30 and the second half section 32 exists in the form of a stop surface 50 at each of the top and bottom portions 40, 42. Each of the stop surfaces 50 extend from an outer surface of the first half section 30 to an outer surface of the second half section 32. In addition, the outer surface of the second half section 32 includes a lock element 52 spaced apart from each of the stop surfaces 50. As will be described in more detail, the stop surfaces 50 and the lock elements 52 cooperatively function to couple an additional ring (e.g., ring 14) together with ring 12.

Remaining with FIG. 4, an inner surface of the first half section 30 of the ring 12 will include two guide notches 54. The guide notches 54 are spaced apart from the stop surfaces 50 on the ring's 12 inner surface. As will be described in more detail, the guide notches 54 are configured to receive an additional ring, such that ring 12 may be coupled with such additional ring (e.g., ring 14). As such, the guide notches 54 may be appropriately sized so as to receive the additional ring.

Figure 5:
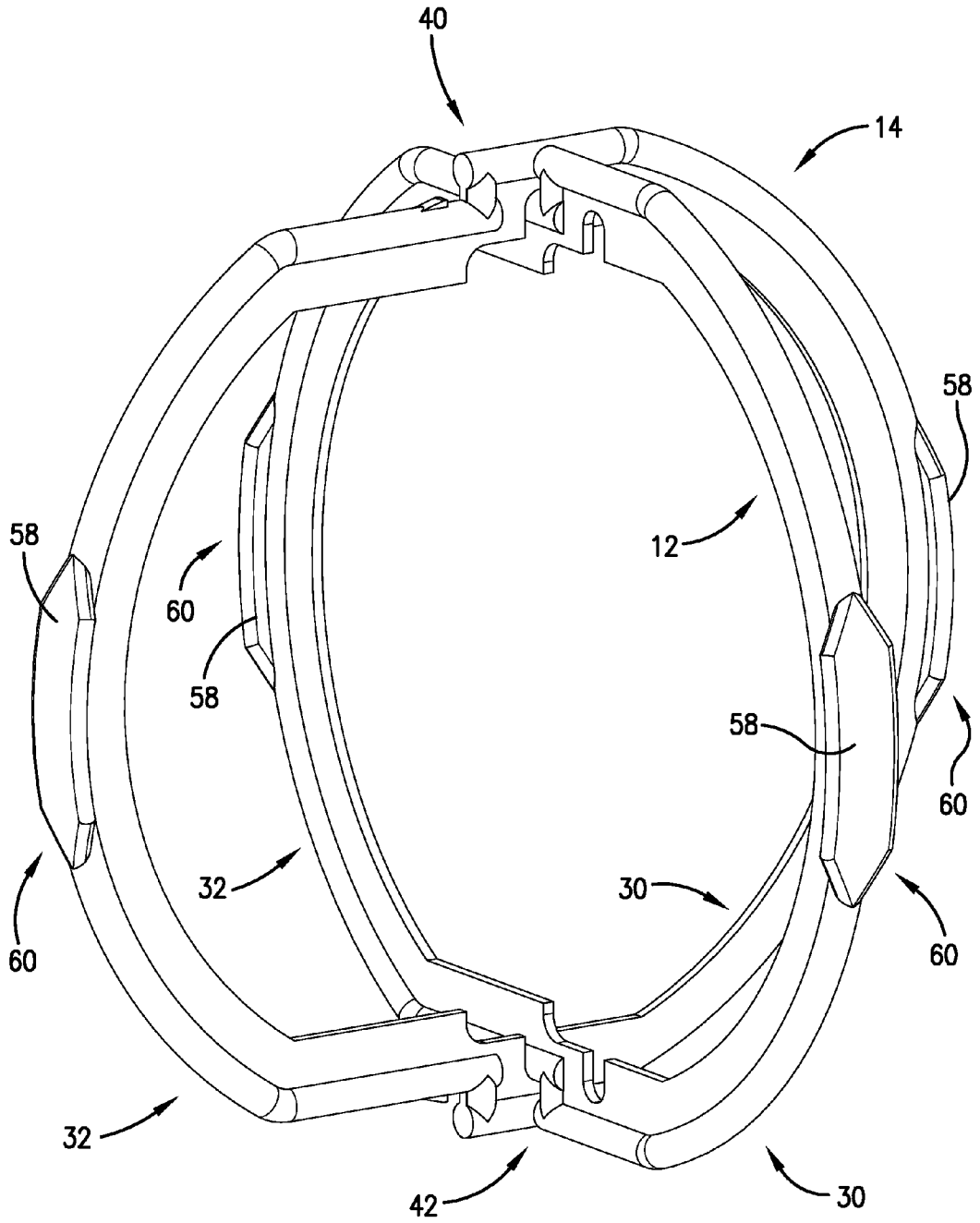
FIG. 5 is a perspective view of a rebar centralizer system according to another embodiment of the present invention, particularly showing a first ring and a second ring each having skid surfaces on portions of their outer surfaces.

As perhaps best shown by FIG. 1, the outer surfaces of the rings 12, 14 may be thicker than the inner surfaces. Such differences in thickness may facilitate the ability for the rings 12, 14 to be coupled together to form the rebar centralizer system 10, as will be discussed in more detail below. Furthermore, the thicker outer surfaces may enhance the ability for the rebar centralizer system 10 to be positioned inside the shaft 22. For instance, a thicker outer surface on the rings 12, 14 will allow the rings 12, 14 to slide down along the sidewall of the shaft 22 more efficiently than an outer surface that is relatively thinner. A thinner surface may unwantedly dig into the sidewalls and encounter more frictional drag and resistance. In some specific embodiments, such as illustrated in FIG. 5, the rings 12, 14 may include one or more enlarged, flat skid surfaces 58 on their outer surfaces. In particular, the skid surfaces 58 may be positioned on the outer surfaces of each of the first and second half sections 30, 32 at a position furthest away from the top and bottom portions 40, 42. Such positions furthest away from the top and bottom portions 40, 42 are indicated as lateral side portions 60. As such, when the rebar centralizer system 10 is assembled, as in FIG. 5, the skid surfaces 58 are configured efficiently slide down along the sidewall of the shaft 22 so as to facilitate the ability for the for the rebar centralizer system 10 to be inserted within the shaft 22.

Figure 8:
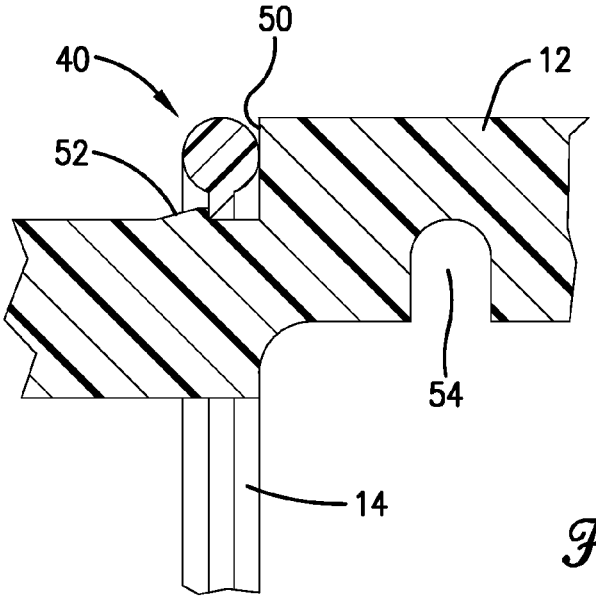
FIG. 8 is a partial cross-section view of the rebar centralizer system as taken along the cross-section line 8-8 of FIG. 7.

To couple the rings 12, 14 together to form the rebar centralizer system 10, as illustrated in FIGS. 1 and 5-7, the first ring 12 is inserted within an interior of the second ring 14. In particular, the second half section 32 of the first ring 12 is inserted within the guide notches 54 on the first half section 30 of the second ring 14. The first ring 12 is inserted as such until the stop surfaces 50 of the first ring 12 contacts a first side of the second ring 14 and the lock elements 52 of the first ring 12 slide underneath the inner surface of the second ring 14 and snap-fit about the opposite, second side of the second ring 14, such as is illustrated in FIG. 8. The lock elements 52 prevent the first ring 12 from backing out from its coupling with second ring 14. Although FIG. 8 only illustrates the top portions 40 of each of the rings 12, 14 being coupled together, it is understood that the bottom portions 42 of each of the rings 12, 14 can be coupled together in a similar manner.

In certain embodiments, the rebar centralizer system 10 may be formed as a single, unitary component instead of being formed from two individual rings (e.g., rings 12, 14) coupled together. In such an embodiment, the single unitary rebar centralizer system would include generally same structure as presented by the coupled rings 12, 14 illustrated in FIG. 1. Such a single unitary rebar centralizer system may be formed via injection molding, 3-Dimensional printing, or the like.

Figure 6:
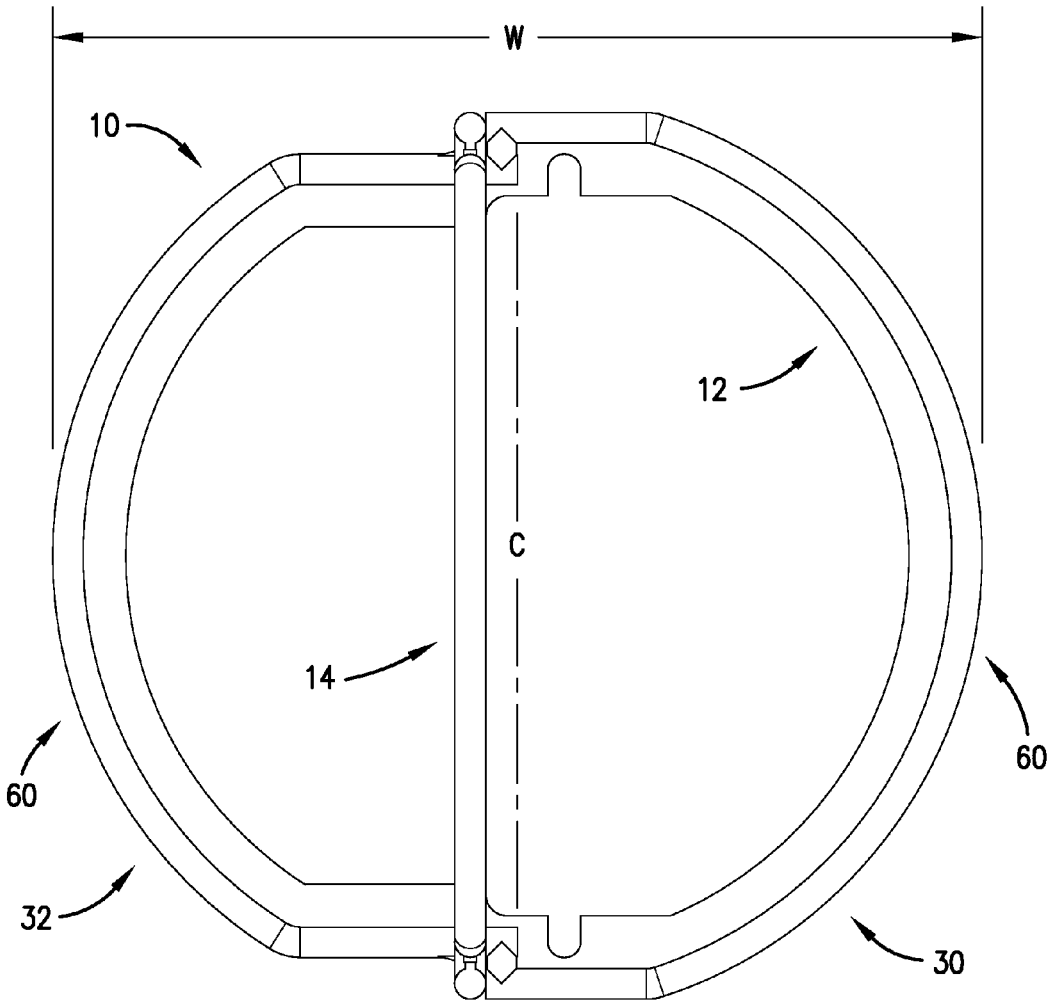
FIG. 6 is an elevational view of the rebar centralizer system of FIG. 1.
Figure 7:
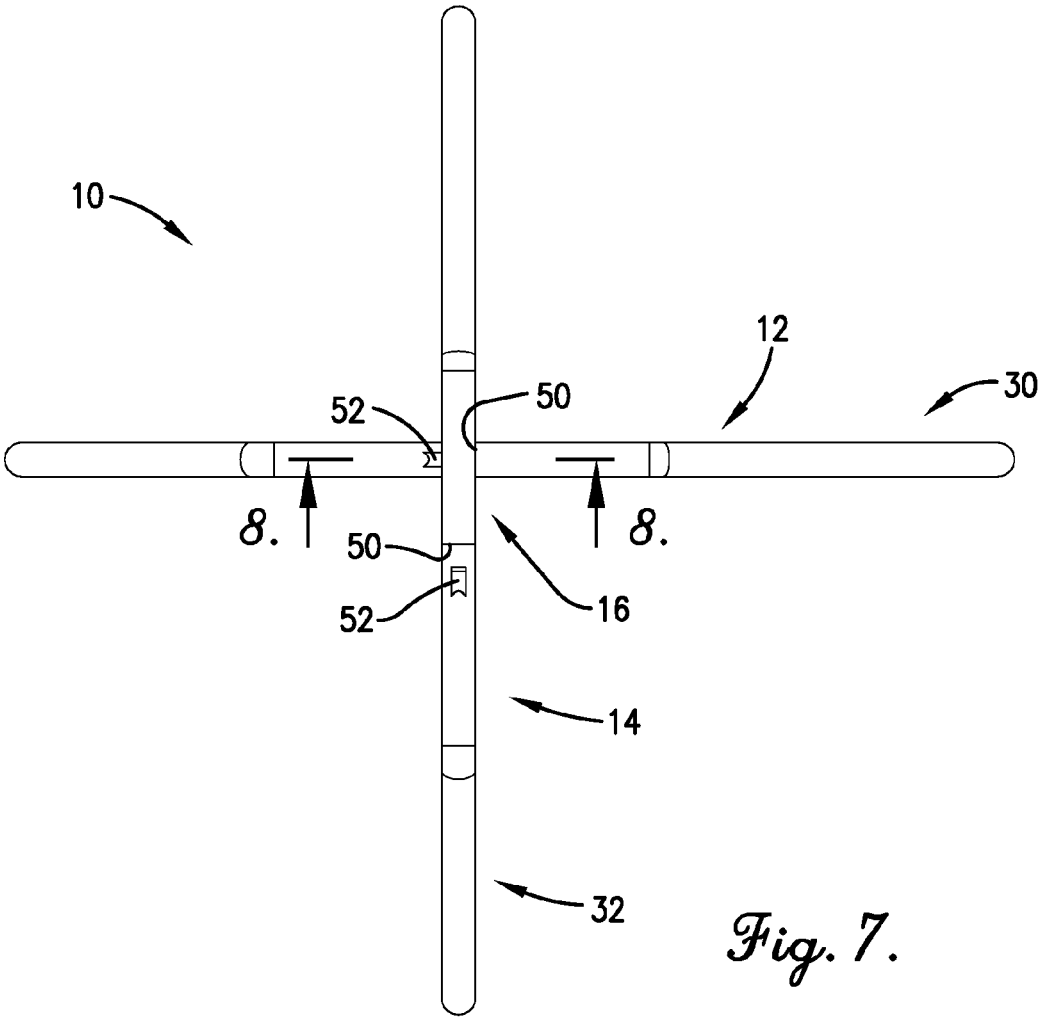
FIG. 7 is a plan view of the rebar centralizer system of FIGS. 1 and 6.

As illustrated by FIGS. 1 and 5-7, the first and second rings 12, 14 are configured to be coupled together in an angular relationship. In some embodiments, such as illustrated in the drawings (and particularly FIG. 7), the rings 12, 14 are coupled such that the rings 12, 14 are generally perpendicular with each other. In other embodiments, the angular relationship may be other than perpendicular. In addition, as perhaps best illustrated in FIGS. 6-7, the rings 12, 14 are coupled together in an offset matter. For instance, as illustrated in FIG. 6, the second ring 14 may be aligned generally in a parallel relationship with a centerline C of the first ring 12. However, such second ring is 14 is offset from the centerline C toward the second half section 32 of the first ring 12. As will be described in more detail below, such an offset coupling of the rings 12, 14 will allow the section of rebar 20 to be secured to the rebar centralizer system 10 in a manner that permits the section of rebar 20 to be generally centered between the lateral side portions 60 of each of the rings 12, 14. In more detail, and with reference to FIGS. 1 and 7, the corner 16 in which the section of rebar 20 may be positioned is the corner that separates the first half section 30 of the first ring 12 from the second half section 32 of the second ring 14. As such, embodiments may provide for the section of rebar 20 to be centralized with respect to the rebar centralizer system 10 to within 1 inch, within 0.5 inch, within 0.25 inch, or within 0.12 inch. It is understood that the section of rebar 20 can be positioned in the corner 16 while the section of rebar 20 is positioned horizontal, vertical, or some angle in between.

Figure 9:
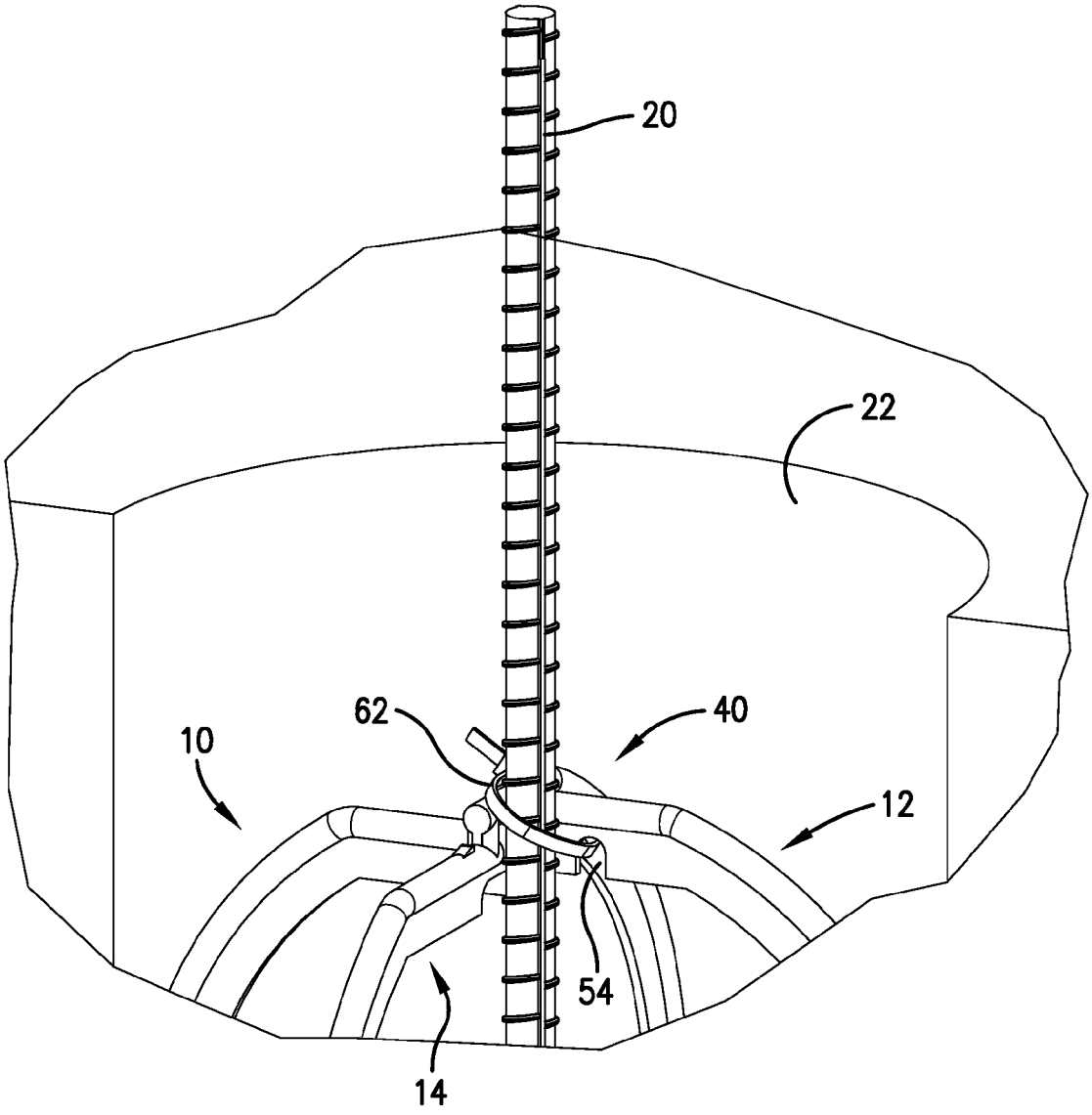
FIG. 9 is a partial view of FIG. 1, showing a top portion of the rebar centralizer system secured to the section of rebar positioned within the shaft, and particularly illustrating a securement component securing the rebar centralizer system to the section of rebar.

Once the section of rebar 20 has been positioned in the corner 16, the section of rebar 20 can be secured to the rebar centralizer section 10 by one or more securement components. Such securement components may comprise a zip-tie 62, as illustrated in FIG. 9. Alternatively, the securement components may comprise a wire-tie, a heavy-duty cord, or the like. Such securement components may be less than 16 inches, less than 12 inches, or less than 8 inches in length. As shown in FIG. 9, the zip-tie 62, or other securement component, can wrap around one or both of the rings 12, 14 and the section of rebar 20 so as to secure the section of rebar 20 to the rebar centralizer system 10. In some embodiments, the zip-tie 62, or other securement component, can extend through the notch 54 on the first ring 12, so as to prevent the zip-tie 62 from moving out of place. In addition to the zip-tie 62, or other securement component, that secures the section of rebar 20 to the top portions 40 of the rings 12, 14, an additional zip-tie 62, or other securement component, can secure the section of rebar 20 to the bottom portions 42 of the rings 12, 14.

Given the rebar centralizer system 10 discussed above, embodiments of the present invention provide a method for centrally positioning a section of rebar in a shaft formed in section of material, such as the earth or ground. To begin, the method initially includes providing the first ring 12 and the second ring 14 in a manner, such that the rings 12, 14 at least partially intersect so as to present the interior corner 16. Next the method includes positioning the section of rebar 20 adjacent to the first and second rings 12, 14 within the interior corner 16. A next step of the method includes securing the section of rebar 20 to the first and second rings 12, 14, such as by one or more securement components (e.g., zip-ties 62). A final step in the method includes placing the section of rebar 20 within the shaft 22. In particular, the lateral side portions 60 of each of the first and second rings 12, 14 may contact the sidewall the shaft 22, such that the section of rebar 20 is longitudinally aligned within the shaft 22. Beneficially, an enlarged thickness of the outer surfaces of the rings 12, 14 permits the section of rebar 20 to be efficiently slid down into the shaft 22 without the section of rebar 20 dragging through the sidewalls of the shaft 22.

Although some embodiments of the present invention include use of only a single rebar centralizer system 10 with a section of rebar 20, to enhance the ability of the section of rebar 20 to be maintained in alignment with the shaft 22, certain other embodiments of the present invention such as illustrated in FIG. 2, may provide for a plurality of rebar centralizer systems 10 (i.e., with each system comprised of two rings) to be positioned along the length of the section of rebar 20. In certain embodiments, it may be preferred for a rebar centralizer system 10 to be placed between every 6 to 30 inches, between every 12 to 24 inches, or about every 15 inches about the length of the section of rebar 20. In other embodiments, it may be preferred for a rebar centralizer system 10 to be placed between every 30 to 120 inches, every 120 to 180 inches, or between every 180 to 240 inches about the length of the section of rebar 20. In certain embodiments, a first of the rebar centralizer systems 10 may be coupled with the section of rebar 20 starting at between about 3 to 12 inches or between about 12 to 24 inches from an end of the section of rebar 20.

Once the section of rebar 20 is properly positioned in the shaft 22, concrete can be poured into the shaft 22 so as to create the foundation element, such as a pile. However, as previously described, certain embodiments may provide for the concrete to be poured (or injected) into the shaft 22 prior to the section of rebar 20 and the rebar centralizer systems 10 being inserted into the shaft 22. Regardless, the rebar centralizer systems 10 beneficially allows the section of rebar 20 to be centrally positioned within the shaft 22 so as to enhance the strength and stability of the foundation element. Furthermore, the rebar centralizer systems 10 allows the section of rebar 20 to be inserted within the shaft without gouging the sidewalls of the shaft 22, which may cause cave-ins and/or otherwise may pull soil, sand, or rock into the concrete so as to contaminate and/or weaken the foundation element.

The rebar centralizer systems 10 can be formed in various sizes such that they can be used to make foundation elements (e.g., piles) of different sizes and shapes. For instance, the rebar centralizer system 10 can have a maximum width W (See FIG. 1), as defined as the outer diameter extending between the lateral side portions 60 of a given ring (e.g., first ring 12 or second ring 14) of between 4 to 60 inches, between 8 to 40 inches, between 10 to 30 inches, or between 12 to 24 inches. As such, embodiments of the present invention can be used with shafts 22 having a size of between 4 to 60 inches, between 8 to 40 inches, between 10 to 30 inches, or between 12 to 24 inches in diameter. Furthermore, in certain specific embodiments, the width W of the rebar centralizer system 10 may be about 11 inches, 12 inches, 13 inches, 14 inches, 15 inches, 16 inches, 17 inches, 18 inches, 19 inches, 20 inches, 21 inches, 22 inches, 23 inches, or 24 inches.

The rebar centralizer system 10 may be used with sections of rebar 20 of various sizes. For instance, the sections of rebar 20 may be any sized bars ranging from #3 bars to #18 bars, with such sections of rebar 20 having dimensions of between 0.375 to 2.257 inches in diameter. In other embodiments, the sections of rebar 20 may be any sized bars ranging from #7 bars to #11 bars, with such sections of rebar 20 having dimensions of between 0.875 to 1.410 inches in diameter.

Figure 10:
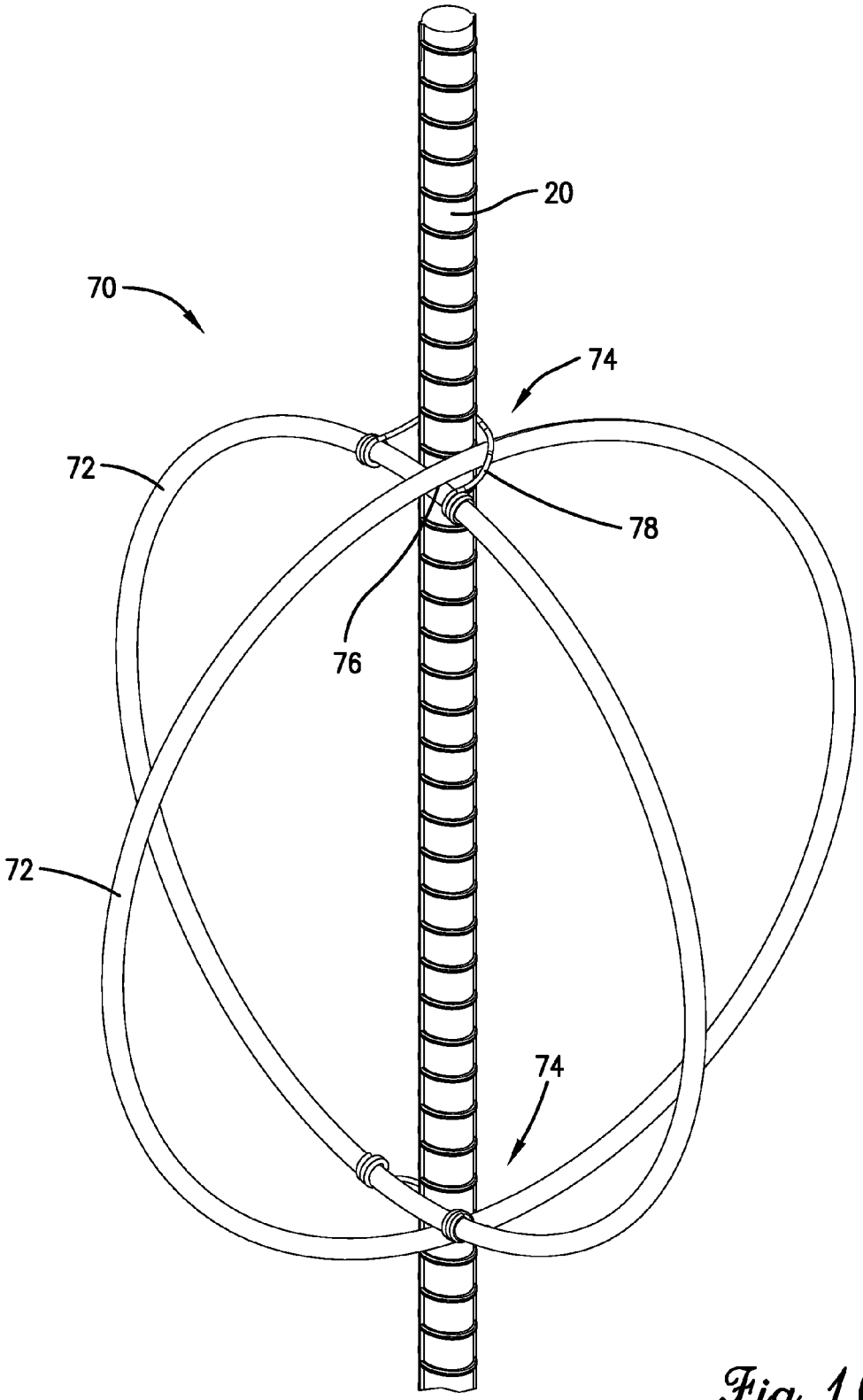
FIG. 10 is a perspective view of a rebar centralizer system according to yet another embodiment of the present invention, particularly showing a first wire ring and a second wire ring secured to a section of rebar.

In addition to the rings 12, 14 described above with respect to FIG. 1-9, embodiments of the present invention also include a rebar centralizer system 70 that is formed from two generally circular wire rings 72, as shown in FIG. 10. The wire rings 72 may be formed from metal, such as iron, steel, stainless steel, carbon-modified steel or the like. In other embodiments, the wire rings 72 may be formed from non-metal materials. In certain embodiments, the metal wire rings 72 may be formed from metal round rods, such metal rods having dimension of between 0.125 to 0.5 inches or between 0.1875 to 0.25 inches in diameter. In some embodiments, the wire rings 72 may be coated with various materials to reduce corrosion of the wire rings 72, such as a zinc coating.

To form the rebar centralizer system 70, a first wire ring 72 is inserted within an interior of a second wire ring 72. Although the first and second wire rings 72 may be formed with generally identical sizes, the coupling of the first and second wire rings 72 can be performed to allow an offset (as was described above with respect to rebar centralizer system 10) because the interior diameter of the wire rings 72 is smaller than the exterior diameter of the wire rings 72. As such, the first wire ring 72 can be positioned within the second wire ring 72 until the outer surface of the first wire ring 72 contacts the inner surface of the second wire rings 72, as shown in FIG. 10. Furthermore, the wire rings 72 can be orientated in an angular relationship, such as perpendicular, so as to present interior corner 74 in which a section of rebar 20 can be positioned. Because the interior corner 74 is offset from a center of the rebar centralizer system 70, the section of rebar 20 can be inserted within the corner 74 in a manner that is generally centered with respect to the rebar centralizer system 70. The wire rings 72 of the rebar centralizer 70 can be secured in such a position via weld 76 or via a securement component (e.g., wire-tie 78 or zip-tie). Similarly, the section of rebar 20 can be secured to the rebar centralizer system 70 via weld or via securement component.

Upon the coupling of one or more of the rebar centralizer systems 70 with a section of rebar 20, the section of rebar 20 can be positioned with a shaft, such as shaft 22 as was previously described. Thereafter, a foundation element can be formed by pouring concrete into the shaft and 22 and covering the section of rebar 20 and the rebar centralizer systems 70.

Embodiments of the present invention provide for the rebar centralizer systems 10, 70 to be custom fabricated to a customer's specifications of shaft size, rebar size, and foundation element strength/stability requirements. The rebar centralizer systems 10, 70 can be produced fully assembled or can be shipped unassembled for reducing on freight costs and storage requirements. When shipped fully assembled, the rebar centralizer systems 10, 70 can be nested together and packaged for efficient use of space during shipping and for storage.

It is the inventor's intent to rely on the Doctrine of Equivalents to determine and assess the reasonably fair scope of the present invention as it pertains to any apparatuses, methods, or kits not materially departing from but outside the literal scope of the invention as set forth in the following claims.

What is claimed is:

1. A rebar centralizer system for assisting with positioning of at least one section of rebar, said rebar centralizer system comprising:

a first ring aligned substantially within a first plane; and a second ring aligned substantially within a second plane, wherein said first ring and said second ring are positioned such that the first plane and the second plane are oriented in an angular relationship, wherein said first ring and said second ring intersect so as to present at least one interior corner for receiving the section of rebar, wherein the second plane is aligned in parallel relationship with a centerline of said first ring, and wherein the second plane is offset from the centerline of said first ring such that said first ring and said second ring intersect in an offset manner to present the at least one interior corner, and at least one securement component for securing said first ring and said second ring to the section of rebar, wherein at least a portion of the section of rebar is retained within the interior corner of said rebar centralizer system.

2. The rebar centralizer system of claim 1, wherein said first ring and said second ring are coupled together in said angular relationship.

3. The rebar centralizer system of claim 2, wherein said angular relationship is perpendicular.

4. The rebar centralizer system of claim 1, wherein the securement component comprises a wire-tie.

5. The rebar centralizer system of claim 1, wherein said first ring and said second ring are comprised essentially substantially of metal.

6. The rebar centralizer system of claim 5, wherein said first ring and said second ring are coupled together via weld.

7. The rebar centralizer system of claim 1, wherein said first ring and said second ring are comprised of plastic.

8. The rebar centralizer system of claim 7, wherein said first ring and said second ring are injection molded.

9. The rebar centralizer system of claim 7, wherein said first ring and said second ring are coupled together via one or more snap-fit connections.

10. The rebar centralizer system of claim 1, wherein an inner surface of said first ring includes at least one notch that receives a portion of said second ring.

11. The rebar centralizer system of claim 10, wherein the inner surface of said first ring includes two aligned notches, wherein said two aligned notches receive portions of said second ring such that said second ring is retained within said first ring.

12. The rebar centralizer system of claim 10, wherein an outer surface of said second ring includes at least one lock element spaced apart from at least one stop surface, and wherein a portion of said first ring is retained between said at least one lock element and said at least one stop surface.

13. The rebar centralizer system of claim 12, wherein the outer surface of said first ring includes a first lock element spaced apart from a first stop surface, and a second lock element spaced apart from a second stop surface, and wherein portions of said first ring are retained between said first lock element and said first stop surface and between said second lock element and said second stop surface.

14. The rebar centralizer system of claim 9, wherein said snap-fit connection comprises at least one lock element spaced apart from at least one stop surface, wherein said one or more snap-fit connections is positioned on an outer surface of said second ring.

15. The rebar centralizer system of claim 1, wherein said first ring includes at least one skid surface positioned on an outer surface of said first ring.

16. The rebar centralizer system of claim 15, wherein said first ring includes at least two skid surfaces, with each of said at least two skid surfaces positioned on opposing lateral side portions of said first ring.

17. The rebar centralizer system of claim 1, wherein said first ring comprises a first half and a second half, and wherein an inner diameter of said first ring across said first half is greater than an inner diameter of said second ring across said second half.

18. The rebar centralizer system of claim 17, and wherein an outer diameter of said first ring across said first half is greater than an outer diameter of said second ring across said second half.

19. The rebar centralizer system of claim 1, further comprising a third ring and a fourth ring, wherein said third ring and said fourth ring intersect so as to present at least one interior corner for receiving the section of rebar.

20. The rebar centralizer system of claim 19, wherein said first ring and said second ring are set apart from said third ring and said fourth ring by at least 15 inches.

* * * * *